United States Patent [19]

Pronk

[11] Patent Number: 4,957,458

[45] Date of Patent: Sep. 18, 1990

[54] FLOW GUIDING FACE(S) FOR A SHIP

[75] Inventor: Cornelis Pronk, Drunen, Netherlands

[73] Assignee: Lips B. V., Drunen, Netherlands

[21] Appl. No.: 316,975

[22] Filed: Feb. 28, 1989

[30] Foreign Application Priority Data

Mar. 1, 1988 [NL] Netherlands ..... 8800526

[51] Int. Cl.[5] ..... B63H 5/06

[52] U.S. Cl. ..... 440/66; 440/67

[58] Field of Search ..... 440/66, 67, 61, 71, 440/49, 2; 114/150, 166, 162, 163

[56] References Cited

U.S. PATENT DOCUMENTS 3,051,000 8/1962 Keller ..... 114/275
3,455,268 7/1969 Gordon ..... 114/166

FOREIGN PATENT DOCUMENTS 60-99793 6/1985 Japan ..... 440/66
292591 12/1987 Japan ..... 440/66
140053 4/1953 Sweden ..... 440/67

*Primary Examiner*—Joseph F. Peters, Jr.
*Assistant Examiner*—Edwin L. Swinehart

[57] ABSTRACT

Flow guiding faces (1,2) adapted to be arranged at the rear end (4) of a ship with at least one propeller (5). Each flow guiding face is located in front of a propeller (5). The center of the area enclosed by each flow guiding face (1,2) and the hull lies above the centerline of the propeller (5). The spatial angle between the centerline of the flow guiding faces (1,2) and the longitudinal axis of the ship is adjustable.

7 Claims, 1 Drawing Sheet

FLOW GUIDING FACE(S) FOR A SHIP

The invention relates to flow guiding face(s) adapted to be arranged at the rear end of a ship with at least one flow guiding face in front of a propeller, at one or both sides of the ship's longitudinal plane, whereby the centre of the area enclosed by each flow guiding face and the hull lies above the centerline of the propeller.

Such a structure is known from German Patent Specification No. 3,216,578, wherein as preferred embodiment the flow guiding face(s) consist of two half tubes, which are rigidly connected to a vertical plate, which is again rigidly fixed to the ship. The two half tubes are preferably not identical, since by the action of the propeller the flow conditions on portside and starboardside are not the same.

By applying such flow guiding faces the flow on the stern is effected. The upwardly directed flow obtains a downwardly directed impulse, so that the flow towards the propeller becomes more axial. The speed distribution in the propeller disc becomes more equal. The flow remains closer to the stern of the ship. By applying the flow guiding faces in such a way that the profile toward the backside is inclining upwardly in some way the structure yields additional propulsion.

By these effects the propulsion output of the ship is increased. Moreover, the level of the vibrations generated by the propeller will be lower.

At the known embodiment the position and orientation of the flow guiding faces are optimized for the most common condition of the ship concerning draft, trim and speed.

The invention makes it possible to adapt optimally the orientation of each flow guiding face to the sailing conditions. If for instance the ship, owing to weather conditions, is urged to decrease its sailing speed, the orientation of the flow guiding faces can be adjusted immediately to the lower speed. The same is in force for instant change of draft and/or trim.

According to the invention this is obtained in that the spacial angle between the centerline of each of the flow guiding face(s) and the longitudinal axis of the ship is adjustable.

Preferably each flow guiding face(s) near the front side is connected with the ship by means of a hinge, permitting rotation in all directions.

The rear end of each flow guiding face can be removed more or less far from the ship, while at the same time the upper side can be rotated. These movements are shown in the drawings with arrows.

The invention will now be explained with reference to a preferred embodiment, wherein.

Figure 1:
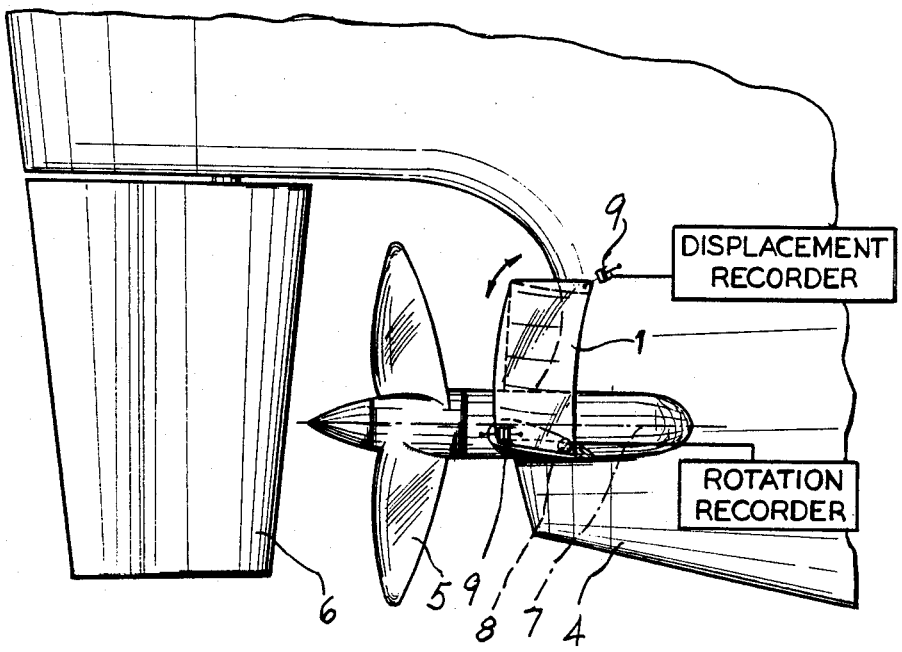
FIG. 1 is a side view of the stern of the ship.
Figure 2:
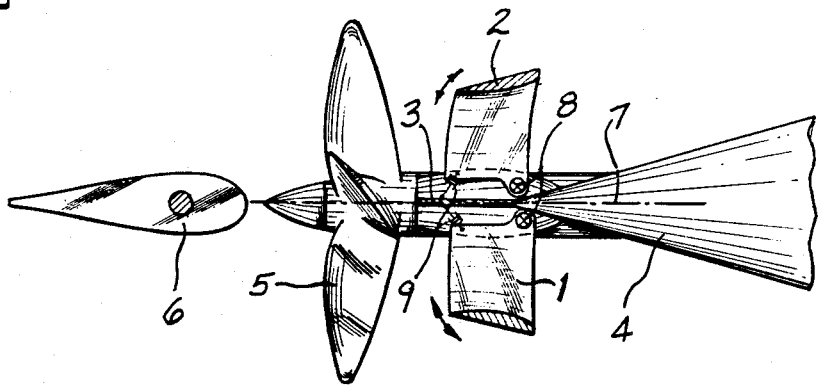
FIG. 2 is a horizontal section on the half height through the tube.

The half tubes are indicated by the reference numerals 1 and 2. The vertical plane is indicated by the reference numeral 3.

The stern is indicated with 4, the propeller with 5, the rudder with 6 and the propeller shaft with 7.

The half tubes 1 and 2 seen in the sailing direction are lying in front of the propeller 5.

The center of the area enclosed by a half tubes 1, 2 and the hull lies at the higher level than the propeller shaft 7.

According to the preferred embodiment each half tube 1, 2 is connected to the ship by means of a ball- and socket joint 8. In order to adjust the orientation of the half tube 1, 2, for instance, hydraulic piston-cylinder devices 9 can be used. These must be oriented at an angle in such a way, that in addition to the adjustability the orientation is determined.

A more simplified embodiment is obtained by replacing the upper piston-cylinder device by a hinge. The orientation of each half tube is then only adjustable in one plane.

The adjusted angle of each half tube 1, 2 can be measured by a displacement recorder on the piston-cylinder devices 9 known per se or with a rotation recorder on one of the hinge points of the simplified embodiment.

As protection a steel cap (not shown) can be arranged over the device 9 and the lower hinge point 8.

The invention is not restricted to the use of two half tubes. The flow faces can have other forms.

What is claimed is:

1. A ship comprising:

a hull having a rear end, a longitudinal axis and a screw propeller adjacent said rear end;

said screw propeller having a centerline;

a flow guide surface adjustably mounted to a portion of said hull in the vicinity of said rear end and in front of said propeller;

said flow guide surface together with said hull defining an area having a center which lies above the propeller centerline; and said flow guide surface being adjustable about more than one axis so that a spacial angle between the longitudinal axis of the hull and a centerline of the flow guide surface may be varied.

2. The ship of claim 1 wherein said flow guide surface comprises a half ring nozzle.

3. The ship of claim 1 wherein said flow guide surface is mounted to said hull portion by at least one hinge near a front edge of said flow guide surface, said at least one hinge permitting rotation of said flow guide surface in all directions.

4. The ship of claim 3 further comprising a rotation recorder connected to said at least one hinge for measuring an adjusted position of said flow guide surface.

5. The ship of claim 1 further comprising:

at least one piston-cylinder device for adjusting said flow guide surface.

6. The ship of claim 5 further comprising:

a displacement recorder on each said piston-cylinder device for measuring an adjusted position of said flow guide surface.

7. A ship comprising:

a hull having a rear end and a longitudinal axis;

at least two propellers being mounted a hull;

a first of said propellers being mounted along a first side of said hull adjacent said rear end;

a second of said propellers being mounted along a second side of said hull adjacent said rear end;

each of said first and second propellers having a centerline;

adjustable flow guide surfaces mounted to said hull in front of said first and second propellers;

each of said flow guide surfaces together with said hull defining an area having a center which lies above a centerline of one of said first and second propellers; and each of said flow guide surfaces being adjustable about more than one axis so that a spacial angle between the longitudinal axis of the hull and one of said flow guide surface centerlines may be varied.

* * * * *